United States Patent [19]

Gangnath et al.

[11] Patent Number: 4,625,342

[45] Date of Patent: Dec. 2, 1986

[54] DEVICE ACTUATED BY TOILET FLUSHING FOR DISPENSING DEODORANT

[75] Inventors: Robert B. Gangnath, Monroe; Nicolae Tudor, Westport, both of Conn.

[73] Assignee: Plus One, Inc., Norwalk, Conn.

[21] Appl. No.: 635,759

[22] Filed: Jul. 30, 1984

[51] Int. Cl.[4] ..... E03D 9/02

[52] U.S. Cl. ..... 4/228; 4/222; 222/163; 222/402.13

[58] Field of Search ..... 4/227, 228, 223, 222, 4/406, DIG. 3; 222/402.13, 402.15, 163, 285

[56] References Cited

U.S. PATENT DOCUMENTS

| | | | |
|---|---|---|---|
| 1,225,418 | 5/1917 | Doering | 222/285 |
| 3,023,427 | 3/1962 | Behringer | 4/228 |
| 3,068,492 | 12/1962 | Price | 4/222 |
| 3,093,835 | 6/1963 | Kaplan | 4/228 |
| 3,143,745 | 8/1964 | Price | 4/222 |
| 3,371,355 | 3/1968 | Wipf | 4/222 |
| 3,420,445 | 1/1969 | Inzerill | 4/223 |
| 3,972,447 | 8/1976 | Fegley | 222/402.15 |
| 4,064,573 | 12/1977 | Calderone | 4/227 |
| 4,358,860 | 11/1982 | Church | 4/228 |
| 4,380,835 | 4/1983 | Yao | 4/406 |
| 4,392,260 | 7/1983 | Bensen | 4/406 |

FOREIGN PATENT DOCUMENTS

| | | | |
|---|---|---|---|
| 1176777 | 4/1959 | France | 4/227 |

*Primary Examiner*—Stephen Marcus
*Assistant Examiner*—Leo Peters
*Attorney, Agent, or Firm*—John K. Conant

[57] ABSTRACT

This is a device for dispersing a vapor, such as a deodorant or fragrant vapor, into the air when a movable element, such as the actuation arm of a flush toilet, is moved from a usual 'at rest' position. A switch responsive to movement of the movable element from its 'at rest' position closes a circuit which energizes an electrically actuated means, such as a motor or a solenoid operated lever, which when actuated opens the valve of a container from which a vapor of a deodorant or fragrance is dispersed under pressure. The device is particularly adapted for dispersing a deodorant into the air in a bathroom or lavatory when the toilet therein is flushed.

2 Claims, 5 Drawing Figures

DEVICE ACTUATED BY TOILET FLUSHING FOR DISPENSING DEODORANT

BACKGROUND AND SUMMARY OF THE INVENTION

The present invention is a device for eliminating unpleasant odors in bathrooms and the like. In particular it is a device for dispersing a fragrance or deodorant into the air of a bathroom when a conventional flush type toilet therein is flushed.

That efforts have been made for a number of years to try to find an effective system for eliminating unpleasing ordors in bathrooms is evidenced by the disclosure of U.S. Pat. No. 4,168,550 and the prior art patents described therein. It is believed the reason that devices and systems for eliminating odors in bathrooms are not in significant use today despite the number of different ones known in the prior art is because previously known systems and devices are too complex and/or expensive to be practical or have not worked effectively.

It is an object of the present invention to provide a bathroom deodorizing device that is practical, economical and effective.

The device of the present invention uses readily available conventional pressurized containers of deodorant or fragrance and is adapted to be connected to a conventional flush toilet mechanism without having to provide expensive special fixtures or having to modify the mechanism. The device makes economical use of the deodorant or fragrance by dispensing it only when the toilet is flushed, which is usually the time when it is most effective.

The device of this invention consists of a support for a conventional container of a deodorant or fragrance under pressure which has a valve that releases vaporized deodorant or fragrance when the valve is depressed. The support also carries a battery operated electrical means for rotating a lever arm in a direction to depress the container valve to release vapor. The electrical means may be any suitable means such as a d.c. electric motor connected through a gear train to rotate the lever arm, or, alternatively, a solenoid having its armature linked to rotate the lever arm.

The electrical means is actuated by a tilt switch that is mounted on the actuation arm of the toilet flushing mechanism in a position such that the switch closes a cicuit which connects the electrical means to batteries to actuate the electrical means and cause the container valve to be opened and dispense vapor when the actuation arm of the flushing mechanism moves from its usual 'at rest' position when the toilet is flushed.

It will be appreciated that though this device is adapted primarily for use in combination with a conventional flush toilet in a bathroom, it has other useful applications. The essential feature of the device of this invention is that it releases a vapor when a movable element, such as the actuation arm of a toilet flushing mechanism, moves in a predetermined direction from a usual 'at rest' position. Thus the device can be connected to dispense a deodorant or fragrance when a garbage can lid is raised, or to disperse vaporized insect repellant when a screen door is opened, for example.

BRIEF DESCRIPTION OF THE DRAWINGS

Further objects, advantages and features of the invention will be apparent from the following more detailed description of preferred embodiments of the invention illustrated in the accompanying drawings in which.

DETAILED DESCRIPTION

Figure 1:
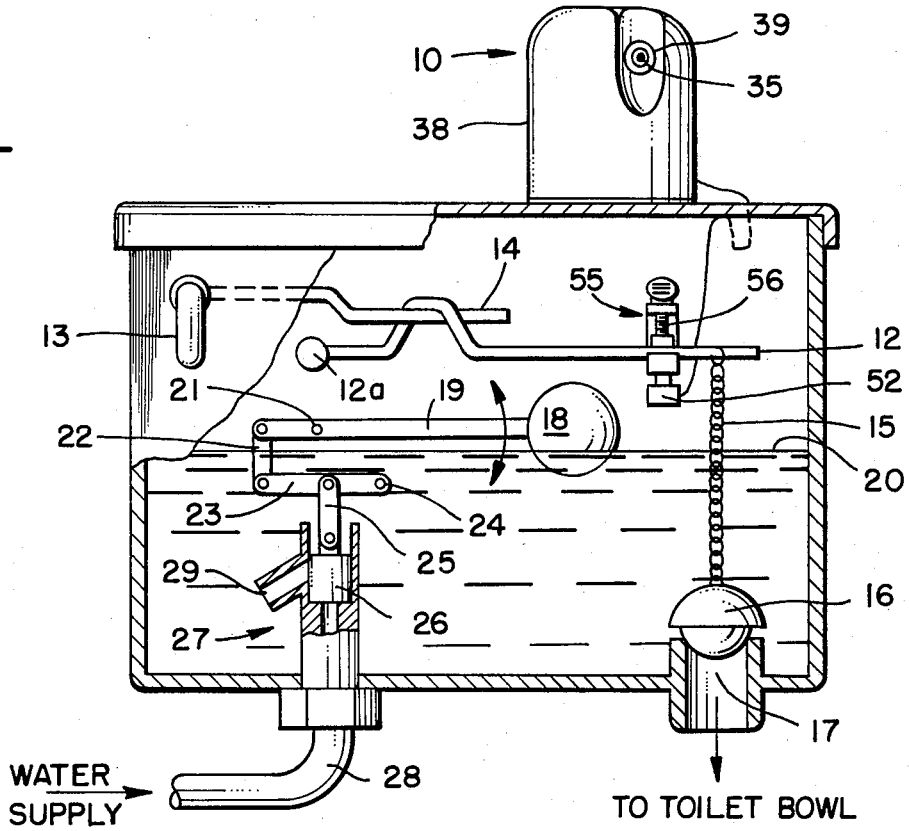
FIG. 1 is a side elevation, partly in section, of a conventional toilet tank including a usual type of flushing mechanism and showing the manner in which the device of this invention is connected for use therewith.

Referring to FIG. 1 of the drawings, a deodorant or fragrance dispensing device 10 of this invention is primarily adapted and intended for use with a conventional flush type toilet that has a water tank 11 in which the flushing mechanism is located. FIG. 1 illustrates a typical flushing mechanism. The particular structure and arrangement of various brands and types of flushing mechanisms vary to quite an extent, but substantially all include an actuation arm 12, or comparable element, which is raised or moved in some predetermined direction when a handle 13, outside the tank 11, is turned to actuate the flushing of the toilet (not shown). The flushing action is initiated by turning and releasing the handle 13.

When the handle 13 is turned an arm 14, which is fixed to the handle and which extends through the tank wall into the tank, has an offset, crank type end portion, as shown, that extends under and lifts up the actuation arm 12 as the handle 13 turns. The ctuation arm 12, pivoted at 12*a*, is connected by a chain or cable 15 to a ball valve 16 which is seated in the tank outlet 17. The tank outlet 17 leads to the toilet bowl (not shown). Lifting the actuation arm 12 thus lifts the ball valve 16 up from the outlet 17, opening the outlet and permitting water from the tank to rush out through the outlet to swirl through and flush out the toilet bowl. When the handle 13 is released the actuation arm 12 returns to its usual 'at rest' position shown in FIG. 1. The momentary movement of the actuation arm 12 when the toilet is flushed is utilized to actuate the deodorant or fragrance dispensing device 10 of this invention in a manner subsequently described below.

As the water level drops from its usual level, indicated at 20, when the flushing action is initiated, and the water rushes out the outlet 17, the ball valve 16 floats above the outlet opening by its own buoyancy and by the action of the water rushing out under it. Then as the water level drops to about the level of the outlet 17 the ball valve 16 reseats in the outlet 17 and stops the outflow.

Also as the water level in the tank 11 drops from the level 20 a float 18 on the end of an arm 19 follows the level down so that the arm 19, pivoted at 21, swings; the end of arm 19 having the float 18 on it swings down and the opposite end swings up. The latter end is connected through a link 22 to a lower arm 23, which is pivoted at 24, and lifts the lower arm 23. The arm 23 has a vertical link 25 hanging from it and the lower end of the link 25 is attached to a gate element 26 of inlet valve mechanism 27. When the arm 23 is lifted, as above, it lifts the link 25 and gate element 26 from its usual closed position, shown in FIG. 1, and permits water from a water supply inlet pipe 28 to flow into the tank 11 through an inlet 29.

When the ball valve 16 recloses the outlet 17, as described above, water entering the tank through the inlet 29 raises the water level back up to its usual level 20.

Figure 4:
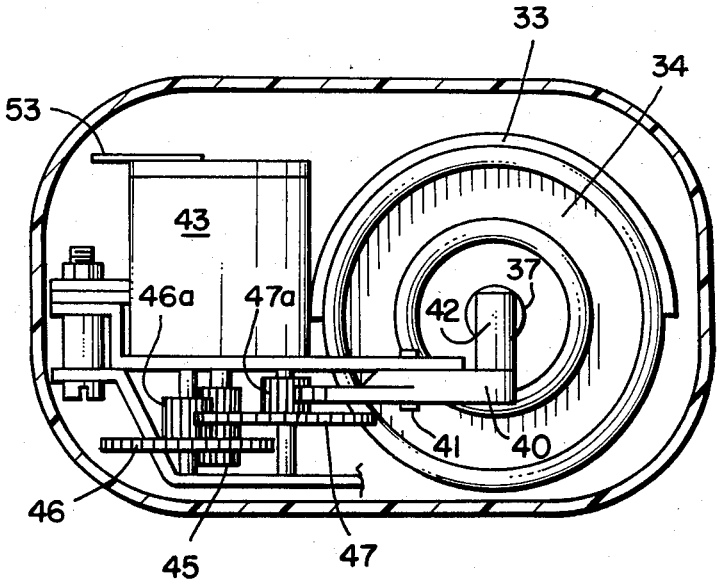
FIG. 4 is a section along the line 4—4 of FIG. 2 looking in the direction of the arrows.
Figure 2:
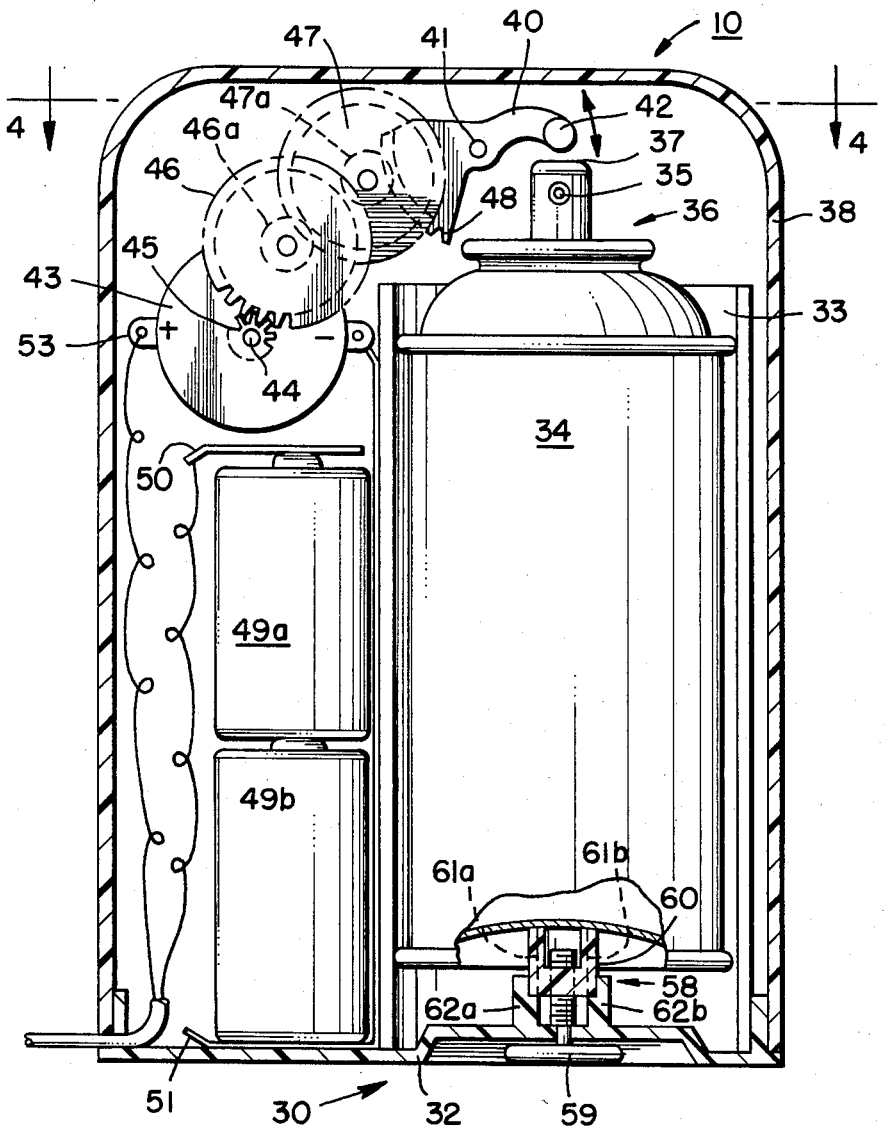
FIG. 2 is a side elevation, in section, of the major portion of a device of this invention.

Referring now to FIGS. 2 and 4, the device 10 of this invention includes a support 31 having a base 32 and a vertical, semi-cylindrical support portion 33 for supporting a conventional cylindrical container 34 of a deodorant or fragrance. The container 34 contains a deodorant or fragrance under pressure so that it disperses from the container as a vapor through an outlet 35 of the valve 36 at the top of the container (as viewed in FIG. 2) when the valve body 37 is pressed in toward the body of the container.

The container 34 and the elements of the device on the support 31 are enclosed by a housing 38 which fits down over the elements and seats on the base 32 of the support 31. A hole 39 (FIG. 1) is provided through the housing at a point in line with the valve outlet 35 of a container 34 on the support for vapor dispersed from the container valve outlet 35 to pass through.

When a container 34 is in position on the support 31 its valve 36 is opened to disperse a deodorant or fragrant vapor therefrom by means of a lever arm 40. The lever arm 40 is pivoted at 41 and has an end 42 adapted to engage and depress the valve body 37 when the lever arm 40 is rotated in the valve depressing direction by associated mechanism of the device.

In the embodiment illustrated in FIG. 2 the lever arm 40 is rotated to open the valve 36 by a small d.c. electric motor 43 which has an armature 44 with a gear 45 fixed on the end. When the motor is energized it turns its gear 45 which, by connection through a train of gears—gear 46, gear 46*a* coaxially attached to gear 46, and a gear 47—rotates a gear 47*a* that is coaxially attached to gear 47. The gear 47*a* meshes with a gear sector 48 on the end of the lever arm 40 opposite the end 42 of the lever arm, so that the gear 47*a* causes the lever arm 40 which is to rotate in the valve depressing direction when the motor 43 is energized.

In the conventional type of pressurized spray containers, as illustrated by the container 34 depicted in the drawings, the valve 36 is spring loaded to close when the pressure that was applied to depress and thereby open it is released. In the practice of the present invention it has been found satisfactory to rely upon this spring loading of the valve 36 to close the valve 36 and return the lever arm 40 back upward from its valve opening position after the motor 43 has been energized to open the valve 36. That is, a simple unidirectional d.c. motor is suitable for the effective practice of the invention. When the power to the motor 43 shuts off, the spring loading of the valve 36, and possibly also reverse pressure built up in the gears of the gear train, pushes and moves the end 42 of the lever arm 40 back up to let the valve close; the motor then being in an unenergized state its armature 44 is free to rotate in a reverse direction to permit the aforesaid reverse rotation of the lever arm 40.

Electric power to operate the motor 43 is supplied by two 1½ volt dry cell batteries 49*a* and 49*b* which are positioned between positive and negative contacts 50 and 51, respectively.

The application of power from the batteries 49*a*, 49*b* to operate the motor 43 is controlled by a tilt switch 52 which is connected between the positive contact 50 and a positive terminal 53 of the motor 43.

Figure 3:
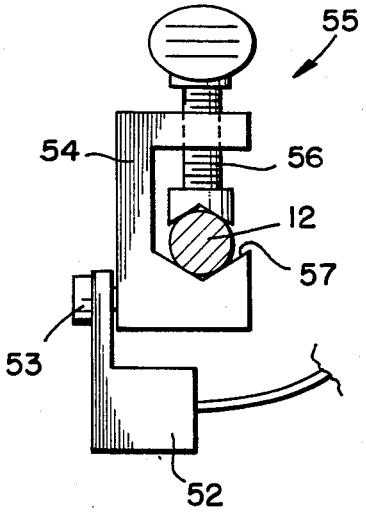
FIG. 3 is a side elevation of the tilt switch and switch mounting mechanism of the device.

As shown in FIGS. 1 and 3 the tilt switch 52 is mounted on the actuation arm 12 of the toilet flushing mechanism in a position to close, and thus energize the motor 43, when the right hand portion (as viewed in FIG. 1) of the actuation arm 12 is moved up from its usual, 'at rest', position when the toilet is flushed.

Referring to FIG. 3, the tilt switch 52 is attached by a screw 53 to the body portion 54 of a clamp 55 which is adapted to clamp onto the actuation arm 12. As shown the clamp 55 is suitably a C type clamp in which a screw 56 through one arm of the C bears against the portion of arm 12 which passes through the center of the C. The screw 56 captures the actuation arm portion between itself and a V-shaped seat 57 in the other arm of the C.

The tilt switch 52 may be any conventional type which is constructed to open an electric circuit in which it is included when the switch body is in one position and which closes, normally by gravity, when the switch body is moved in a predetermined direction from said one position. In the structure shown the position of the tilt switch 52 is adjustable relative to the position of the actuation arm 12 by adjusting the rotational position of the clamp 55 relative to the cross section of the actuation arm and then by adjusting the position of the tilt switch 52 relative to the clamp body 54. This latter is accomplished by loosening the screw 53, rotating the tilt switch around the screw 53 until the switch is in the desired position (open or closed) and then fixing the position by tightening the screw 53 again.

In this manner the tilt switch is adjusted for it to be open when the actuation arm 12 is in its usual 'at rest' position shown in FIG. 1, and to close when it tilts up as the actuation arm 12 swings up when the handle 13 is turned to flush the toilet.

Referring to FIG. 2, the amount and duration of the vapor spray dispersing from the valve 36 of the container 34 is determined by the length of time and the amount the valve body is depressed for opening the valve 36.

In the structure shown the amount and length of time the valve body 37 is depressed to open position is determined by the distance the end 42 of the lever arm 40 must travel to engage and depress the valve body 37. The position of the lever arm 40 and the amount it rotates is not variable and the adjustment for the duration and amount of vapor spray to be dispersed is made by adjusting the vertical position of the container up or down on the support 31 relative to the end 42 of the lever arm 40. This is accomplished by a jackscrew mechanism 58 in the base 32 of the support. It consists of a screw 59 rotatably fixed through the base 32 with a cup-shaped member 60 threaded onto the upper end of the screw. The cup-shaped member is prevented from rotation relative to the screw 59 by vertical grooves 61*a* and 61*b* in the opposite sides of the member 60 which are engaged by vertical posts 62*a* and 62*b* projecting up from the support base 32.

The upper end of the cup-shaped member 60 bears against the bottom of the container 34 on the support 31. Turning the screw 59 thus moves the cup-shaped member 60 up or down between the posts 62*a*, 62*b* and moves the container 34 up or down relative to the end 42 of the lever arm 40.

Figure 5:
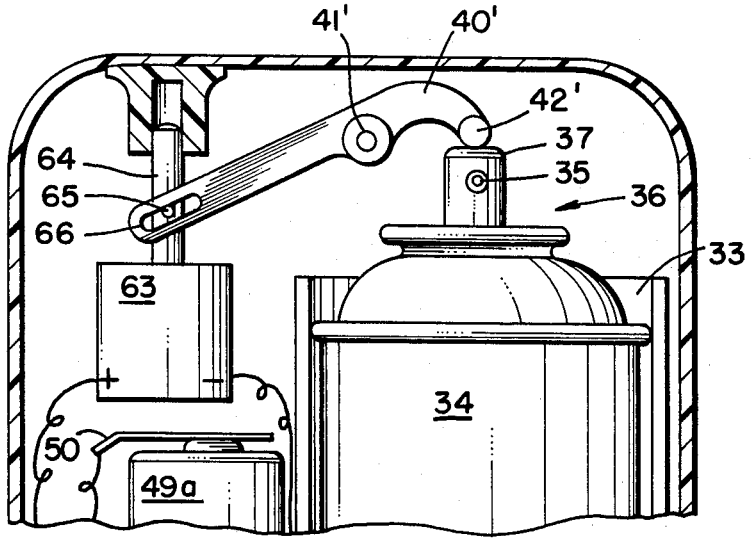
FIG. 5 is a partial sectional view, generally similar to the top portion of the view of FIG. 2, but showing an alternative electrically operable means for rotating the lever arm which operates to open the container valve.

FIG. 5 shows an alternative means for operating the container valve when the toilet is flushed. In this embodiment the motor 43 is replaced by a solenoid 63 which has an armature 64 linked to rotate a lever arm 40' about a pivot point 41' by a pin 65 extending from the side of the armature and projecting through a slot 66 in the lever arm 40'. The operation of this embodiment is the same as the operation of the embodiment described with reference to FIG. 2 except that in this embodiment when the toilet is flushed electric power from the batteries 49*a*, 49*b* actuates the solenoid 63 whose armature 64 thus moves upward (as viewed in FIG. 5). This causes the lever arm 40' to rotate in the direction in which the lever arm end 42' moves down to engage and depress the valve 36 so that the valve opens and a deodorant or a fragrant vapor is dispersed into the air from the valve outlet 35.

What is claimed is:

1. A device for dispensing a vapor into the air in response to the movement in a predetermined direction from a first position of an actuation element of a flush toilet, which actuation element moves in said predetermined direction when said toilet is flushed, comprising in combination with said actuation element:

support means for supporting a container that has a spring loaded valve which opens from a first position when moved in one direction against said spring loading to permit material in said container to disperse therefrom in vapor form, a lever arm pivotally mounted for one end thereof to directly engage and move said spring loaded valve to its open, vapor dispensing position when said lever arm is pivoted in one direction, electrically operable means operable when energized to pivot said lever arm in said one, valve opening, direction, and adapted when deenergized, immediately after being energized, to permit said lever arm to be pivoted in the opposite direction by said spring loading of said valve, which valve is thereby permitted to return to its said first position by said spring loading, means for moving a said container on said support means selectively toward and away from the path of movement of the said lever arm end which engages said valve as means for adjusting the length of the path the valve travels while open, thereby to adjust the amount of vapor that is dispensed from said container, said means for moving a said container on said support means comprising a jack screw mechanism on said support means for engaging the end of said container that is opposite the end of said container that has said valve thereon, a source of electric power for energizing said electrically operable means, and switch means mounted and operable to be responsive to movement of said actuation element in said predetermined direction from its said first position for operably connecting said power source to energize said electrically operable means and thereby cause said valve to be opened when said actuation element moves in said predetermined direction from its said first position and then operable to disconnect said power source from said electrically operable means when said actuation element then moves in the opposite direction back to its said first position.

2. A device for dispensing vapor into the air in response to the movement in a predetermined direction from a first position of an actuation element of a flush toilet, which actuation element moves in said predetermined direction when said toilet is flushed, comprising in combination with said actuation element:

support means for supporting a container that has a spring loaded valve which opens from a first position when moved in one direction against said spring loading to permit material in said container to disperse therefrom in vapor form, a lever arm pivotally mounted for one end thereof to directly engage and move said spring loaded valve to its open, vapor dispersing position when said lever arm is pivoted in one direction, electrically operable means operable when energized to pivot said lever arm in said one, valve opening direction, and adapted when deenergized, immediately after being energized, to permit said lever arm to be pivoted in the opposite direction by said spring loading of said valve, which valve is thereby permitted to return to its said first position by said spring loading, means for moving said container on said support means selectively toward and away from the path of movement of said lever arm end which engages said valve as means for adjusting the length of the path the valve travels while open, thereby to adjust the amount of vapor that is dispersed from said container, a source of electric power for energizing said electrically operable means, an electrical tilt switch mounted on said actuation element for closing an electrical circuit including said power source and said electrically operable means when said actuation element moves in said predetermined direction from its said first position for operably connecting said power source to energize said electrically operable means and thereby cause said valve to be opened when said actuation element moves in said predetermined direction from its said first position and then operable to disconnect said power source from said electrically operable means when said actuation element then moves in the opposite direction back to its said first position, and a clamp device adapted to be removably mounted on said actuation element, said tilt switch being adjustably mounted on said clamp device so that said tilt switch and said clamp device may be mounted on said actuation element in relative positions to each other such that with said actuation element in its said first position said tilt swithch will be open and will close when said actuation element moves in said predetermined direction from its said first position.

* * * * *